US006991503B2

(12) United States Patent
Garcia

(10) Patent No.: US 6,991,503 B2
(45) Date of Patent: Jan. 31, 2006

(54) CONSTRUCTIVE DISPOSITION OF ADJUSTMENT OF THE REMOVABLE LATERAL FINS IN SURFBOARD

(76) Inventor: Antonio Garcia, Rua Domingo Pedro Hermes, 10, Barreiros, CEP-881111-330 Florianopõlis (BR)

( * ) Notice: Subject to any disclaimer, the term of this patent is extended or adjusted under 35 U.S.C. 154(b) by 0 days.

(21) Appl. No.: 10/484,587

(22) PCT Filed: Jul. 17, 2002

(86) PCT No.: PCT/BR02/00202

§ 371 (c)(1),
(2), (4) Date: Jan. 23, 2004

(87) PCT Pub. No.: WO03/018395

PCT Pub. Date: Mar. 6, 2003

(65) Prior Publication Data

US 2004/0235374 A1 Nov. 25, 2004

(30) Foreign Application Priority Data

Jul. 17, 2002 (BR) ..... PCT/BR02/00101

(51) Int. Cl.
*B63B 1/00* (2006.01)

(52) U.S. Cl. ..... 441/79

(58) Field of Classification Search ..... 114/39.15, 114/132, 136, 140; 441/74, 79
See application file for complete search history.

(56) References Cited

U.S. PATENT DOCUMENTS 4,493,665 A 1/1985 Liddle
4,733,496 A * 3/1988 Wallner ..... 441/79
4,854,904 A * 8/1989 Wahl ..... 441/79
5,030,151 A * 7/1991 Beacham ..... 441/79
5,567,190 A 10/1996 Oates
6,053,789 A * 4/2000 Miyashiro ..... 441/79
6,213,044 B1 * 4/2001 Rodgers et al. ..... 114/152
6,386,933 B1 * 5/2002 Rewald et al. ..... 441/74
6,439,940 B1 * 8/2002 Pouchkarev ..... 441/79

FOREIGN PATENT DOCUMENTS

EP 0 834 451 A2 4/1998
WO WO 99/21755 A1 5/1999
WO WO 00/32466 A1 6/2000

* cited by examiner

*Primary Examiner*—Andrew D. Wright
(74) *Attorney, Agent, or Firm*—Christensen O'Connor Johnson Kindness PLLC

(57) ABSTRACT

A fin assembly for adjustably coupling a fin (2) to a board (16). The fin assembly includes a fin having a base (6), the base including a substantially semicircular portion (13) and a front tip (12). The fin assembly also includes a fin box (1) adapted to be attached to a board, the fin box having an opening (3) for receiving the base of the fin. A rear end of the opening has a substantially semicircular portion (5) for receiving the semicircular portion of the base. A front end of the opening has a plurality of rifts (4) for selectively receiving the front tip of the base. Changing the rift that the front tip is disposed in changes an angle of attack of the fin. The fin assembly also includes a fastening assembly (7, 8, 9, 10, and 11) for removably securing the fin to the fin box.

6 Claims, 5 Drawing Sheets

CONSTRUCTIVE DISPOSITION OF ADJUSTMENT OF THE REMOVABLE LATERAL FINS IN SURFBOARD

FIELD OF THE INVENTION

This detailed description refers to a fin assembly for adjusting a set of lateral fins in a surfboard. The fin assembly allows multiple tuning options by means of selectively adjusting a position of a tip of a fin to interface with one of a plurality of graduated rifts in a fitting cup, allowing a surfer to adapt the surfboard to his or her own ability and to the surf, as well as to the marine conditions, without being compelled to use different types of boards.

BACKGROUND OF THE INVENTION

The lateral fins are disposed in the base of the surfboard. The lateral fins are typically formed with plastic foam (polyurethane) molded and covered by a fine layer of polyester resin reinforced with fiber, usually of glass, as has been done since approximately the 1950s. The lateral fins constitute an important accessory of the surfboard, in view of the fact that surfers depend on the positioning of the fins and their disposition in the surfboard to have greater projection and speed or greater stability or greater performance during maneuvers. To meet this need, different fin fitting techniques and positioning techniques have been adopted by others.

In previously developed fin assemblies, the lateral fins are commonly fixed on the lower part of the board, in numbers of one or more, with a current preference of three fins. In previously developed fin assemblies, one of four existing methods are used: (i) fastening the fins to the board through resin reinforced with fiber around the base of the fins, the "adhesive method"; (ii) the use of a "fin box", that allows, theoretically, the removal in cases of damages limited to the fins; (iii) a movable arrangement that allows the fin to be inserted and removed from a compartment inside of the board; (iv) a movable arrangement that, besides allowing the inserting and removal of the fins, allows the movement of the fin fore and aft within the compartment on the board.

It happens that each one of those methods still does not permit the surfer to adjust the fins to the personal and environmental circumstances of each case. (i) The adhesive method of adhering the fins to the boards with fiberglass involves considerable costs of manual work to get the required smooth finish and requires the performance of difficult and high quality work. The adhesive method also interferes in the hydrodynamic properties of the fins, results in a decrease in the height executes of the fin and causes the fixation area to cause water to be pushed outward from the fixation area, generating turbulences and cavitations. Another great disadvantage in the adhesive method is that if any damage occurs to the fin, the entire board remains disabled. (ii) When a "fin box" is used, the disadvantage is noted in the large fin box used during fixation of the fins to the board. The large fin box is expensive and harmful to the board, for it increases the weight of the board and the less strong fixation of the fins to the board can harm the performance and the safety of the fin assembly during use. The advantage regarding fixation by use of a fin box compared to the adhesive method is that the fin box makes possible the removal of the fins in cases of substitution for repairs or transport. However, this advantage is outweighed by its complex structure making adoption difficult. (iii) With regard to the moveable arrangement installed inside the board that allows the more facilitated removal of the fins, although an improvement, doesn't also satisfy the needs of being able to adjust the position of the fins to the conditions of the sea and skill of the user. (iv) While this technique is the most advanced in the art, i.e., having the moveable arrangement accommodation inside the board, because, besides allowing the removal and insertion of the fin, it possesses a longitudinal fitting to receive a member of fixation of the fin through the end of the bow or stern in relation to the fin. Although providing a notable advantage to surfers by providing increased stability, the technique is still lacking since adjustment of an angle of the fin to reduce drag is not permitted, and it results in cavitations and enlarges the projection of the fin and decreases performance during maneuvers.

SUMMARY OF THE INVENTION

In order to solve one or more of the mentioned problems, the fin assembly of the present invention was developed. The fin assembly includes removable lateral fins of a surfboard that, besides permitting the removability of the lateral fins, may provide the possibility of removal of a central fin—when three fins are used. The fin assembly permits the lateral fins to be adjusted to provide multiple angular tuning options permitting surfers the possibility to adapt the surfboard to their own ability to surf, as well as to the marine conditions, without being compelled to use different types of boards.

BRIEF DESCRIPTION OF THE DRAWINGS

The subject matter of the present invention becomes perfectly understood in the following description, which contains references to reference numbers enclosed in the following figures.

DETAILED DESCRIPTION OF THE PREFERRED EMBODIMENT

Figure 1:
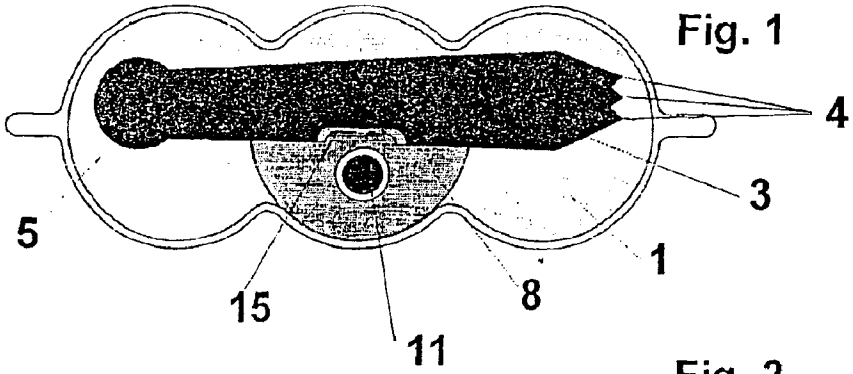
FIG. 1 is a plan view of a fitting cup for receiving a lateral fin, showing an opening having graduated incisions for permitting adjustable fitting of the lateral fin to the fitting cup.
Figure 2:
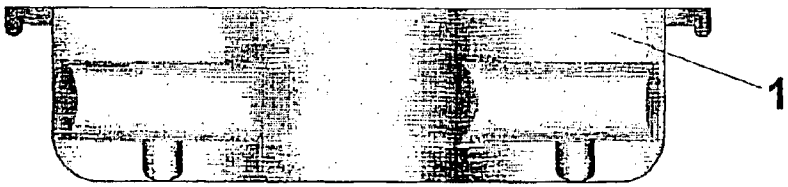
FIG. 2 is an elevation view of the outside face of the fitting cup of FIG. 1 that it is coupled to the inside of the board.
Figure 3:
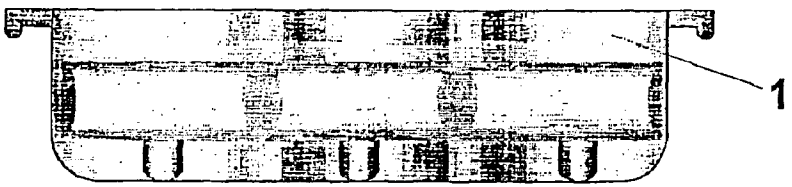
FIG. 3 is an elevation view of the outside face of the lateral fitting cup of FIG. 1 that it is coupled to the outside of the board.
Figure 4:
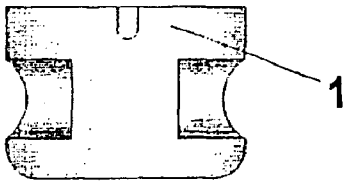
FIG. 4 is a front elevation view of the outside of the fitting cup of FIG. 1.
Figure 6:
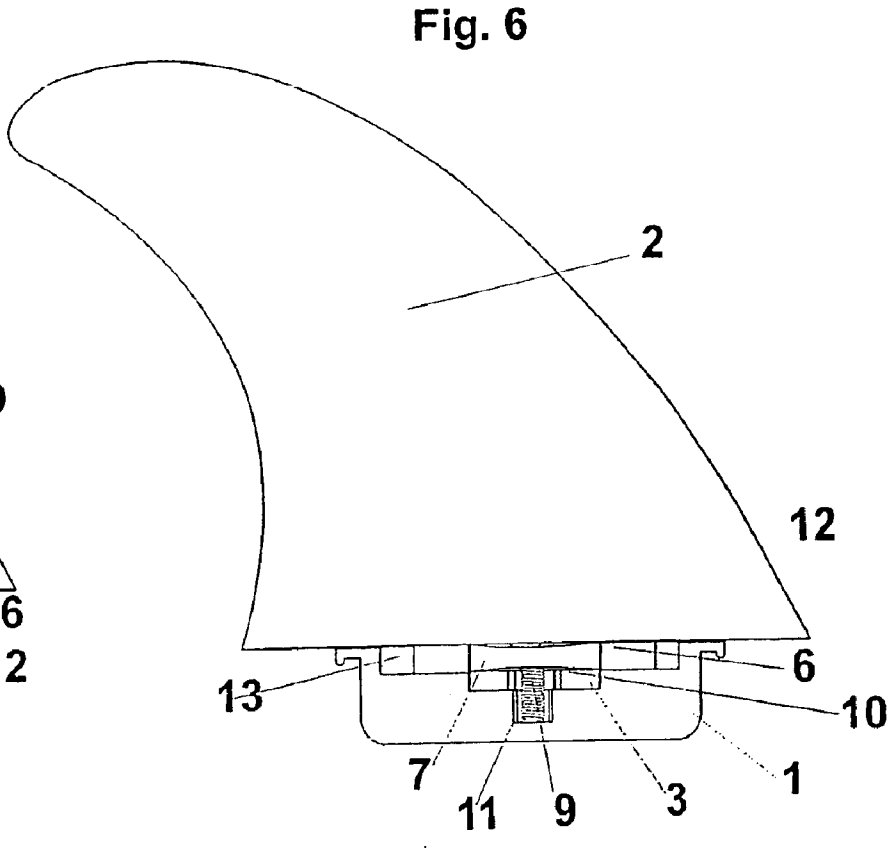
FIG. 6 is a sectional elevation view of the lateral interfaced with the fitting cup.
Figure 5:
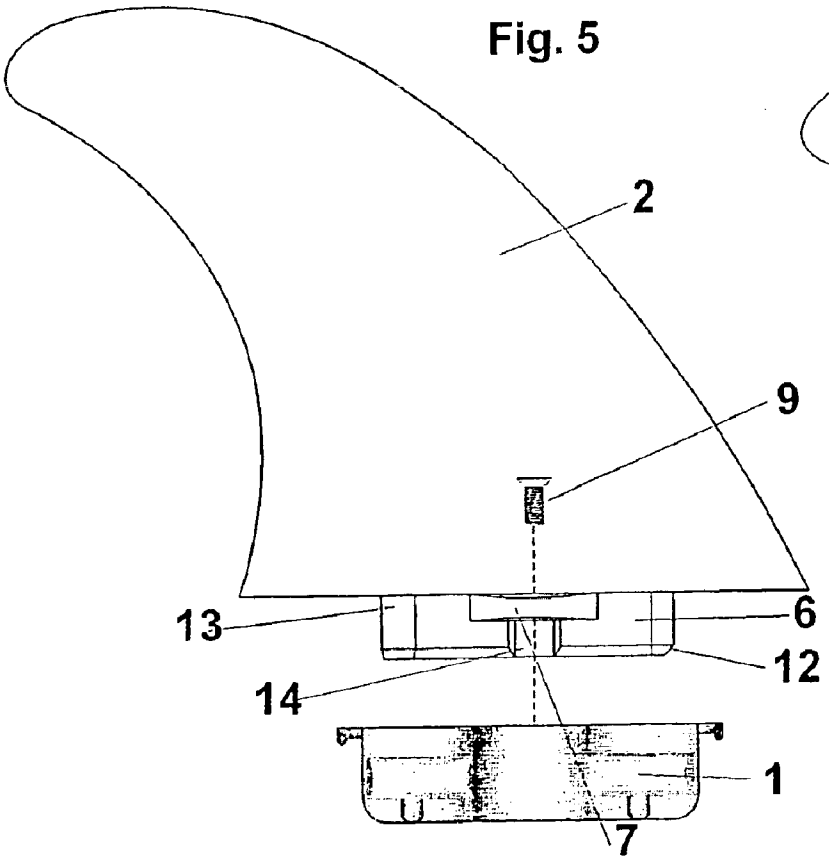
FIG. 5 is a partially exploded elevation view of a lateral fin and fitting cup, showing how the lateral fin interfaces with the fitting cup.
Figure 7:
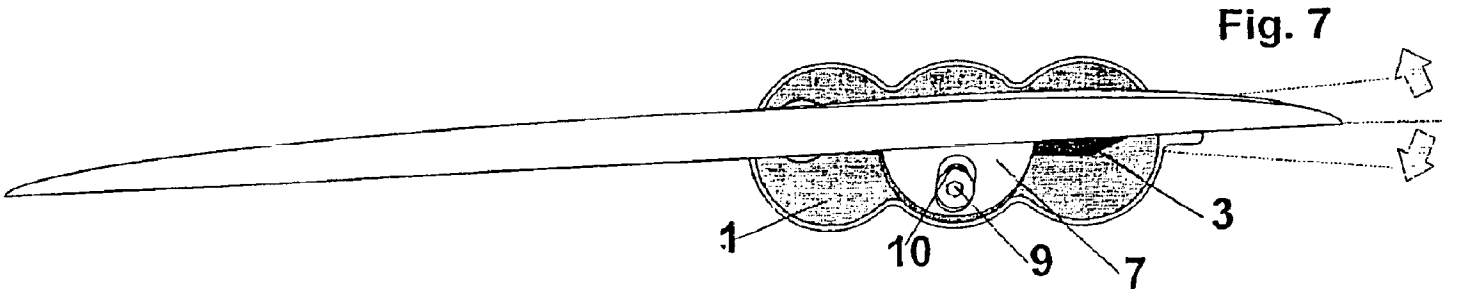
FIG. 7 is a plan view of the lateral fin interfaced with the fitting cup with the lateral fin shown in a fitting position wherein a front of the fin is interfaced with a left graduated tuning rift located toward an outside edge of the surfboard.
Figure 8:
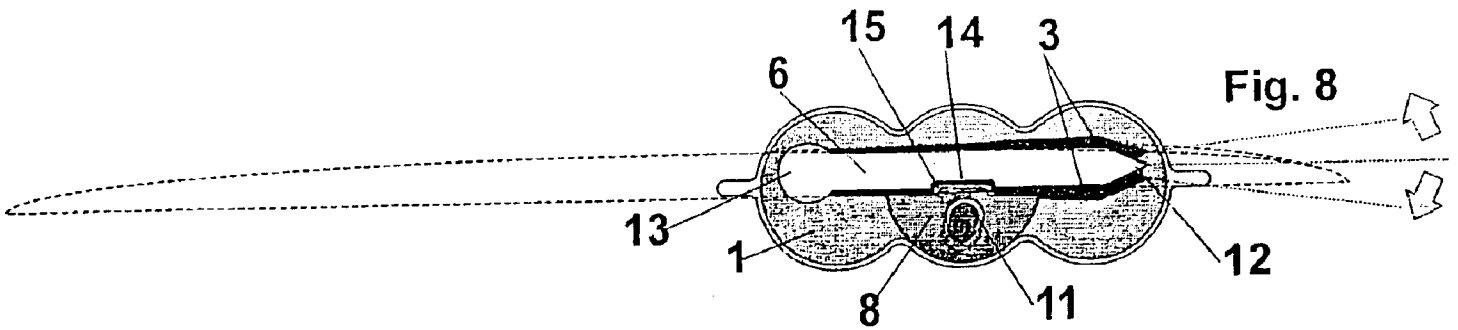
FIG. 8 is a plan view of the lateral fin interfaced with the fitting cup, showing a front of the fin base interfaced with a central graduated tuning rift placing the lateral fin at a central position.
Figure 9:
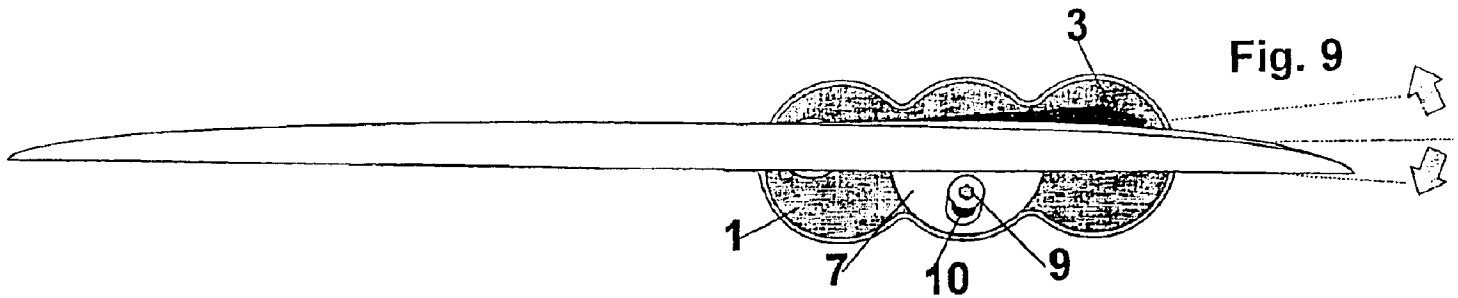
FIG. 9 is a plan view of the lateral fin interfaced with a right graduated tuning rift angularly displacing the later fin to the right relative to the surfboard.
Figure 10:
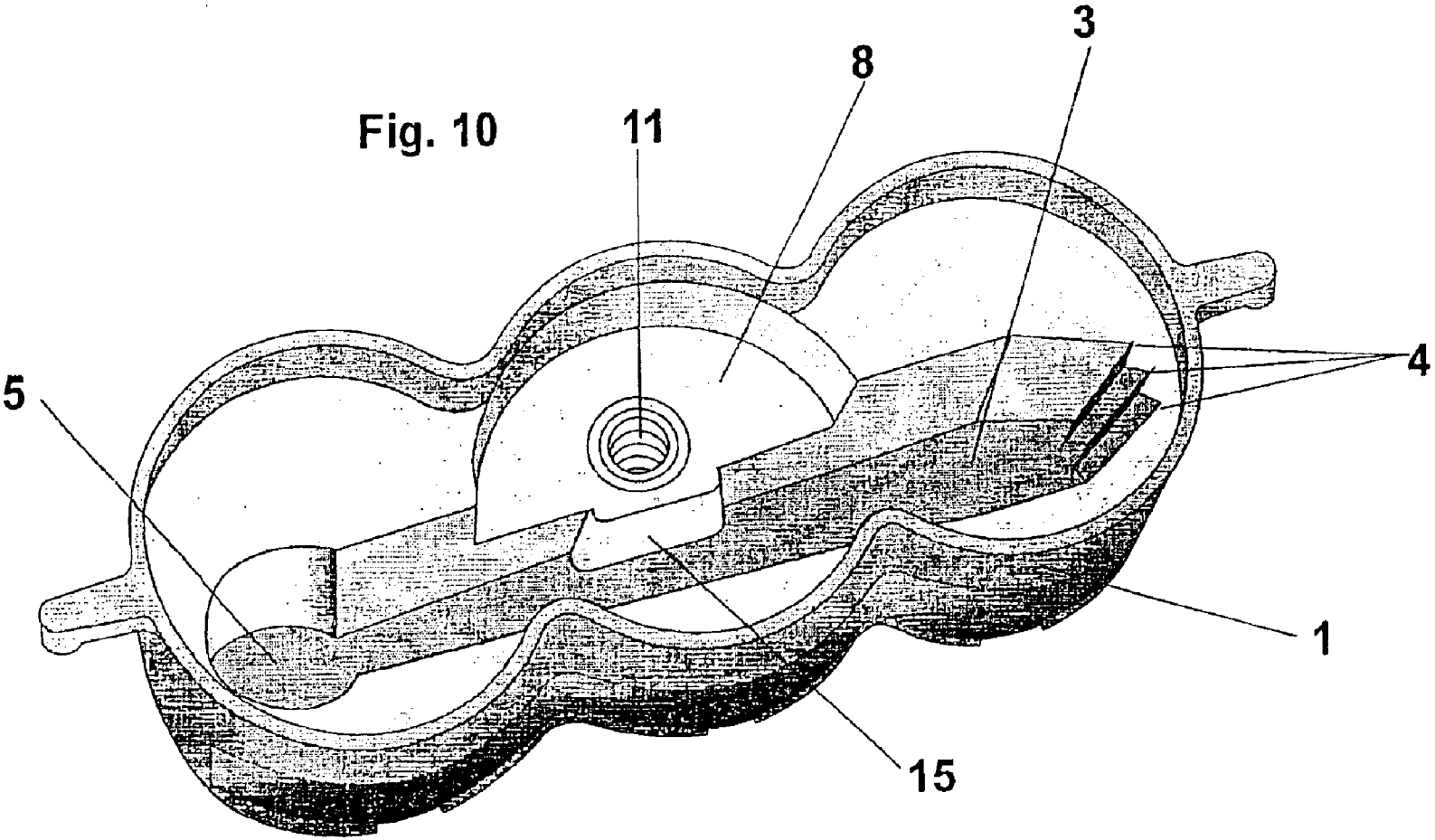
FIG. 10 is a perspective view of the fitting cup.
Figure 11:
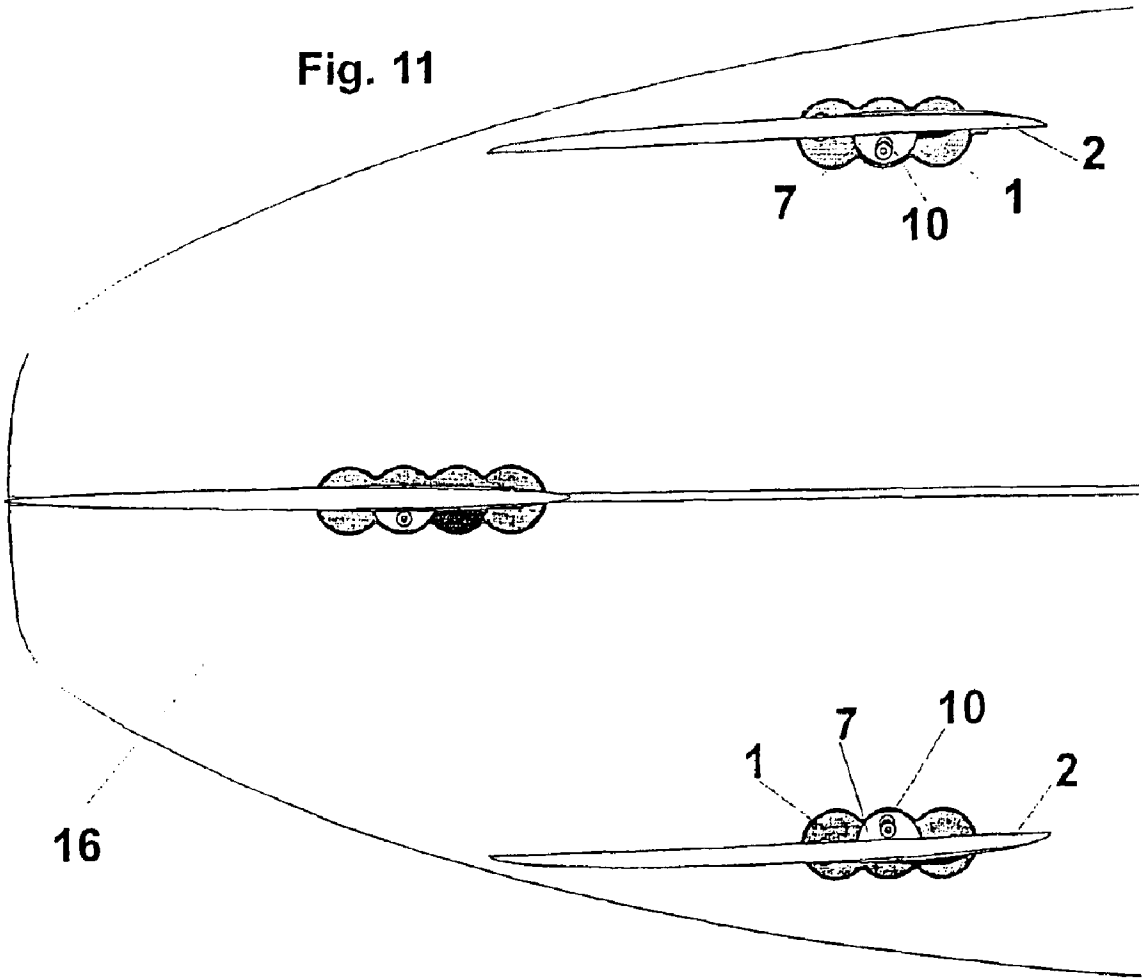
FIG. 11 is a plan view of a tail portion of a surfboard, showing the positioning of the lateral fins related to the central fin.

Regarding the above illustrations, the illustrated embodiment of a fin assembly for permitting adjustment of removable lateral fins in a surfboard is shown. The fin assembly includes a surfboard fin (2) having a base (5) coupled to a fitting cup (1) that includes an opening or incision (3), that possesses in a forward portion graduated rifts (4), which permit the fin to be selectively adjusted to meet the user's needs.

The fitting cup (1) is disposed inside the surfboard tail portion (16), and it is produced in plastic or similar material, of equal or superior lightness and resistance. The fitting cup (1) includes a middle opening or incision (3) having an aft portion (5) which is semicircular in shape and adapted to adjustably receive a correspondingly shaped posterior tip (13) of the fin's (2) base (6), that is rounded. The fitting cup (1) also includes a front portion disposed in front of the middle opening or incision (3). The front portion includes a plurality of graduated rifts (4) that allow, preferably, the fin (2) to be selectively adjusted between three degrees of direction of the fin (2). The fin (2) is fastened by the front tip (12) of the fin's (2) base (6) within one of the graduated rifts (4). The front tip (12) of the fin's (2) base (6) is preferably triangularly shaped and may be selectively interfaced with any one of the three graduated rifts (4) to thereby influence the performance of the surfboard. The graduated positioning of the fin's (2) base (6) front tip (12) to the fitting cup's (1) graduated rifts (4) happens with assistance by the bearings of the fin's (2) base (6) posterior tip (13) rotating within the semi-circular shaped aft portion (5) of the fitting cup's (1) back tip.

The fin (2) is adjustably coupled to the fitting cup (1) by the fixation of an edge (7) that extends laterally outward from the fin's (2) base (6) into a void accommodation space (8) of the fitting cup (10). The edge (7) is secured within the void accommodation space (8) through a flat head screw (9) that slides within a slot (10) disposed in the lateral edge (7) and that attaches to a threaded hole (11) disposed in the center fitting cup (1), close to the inside lateral face of the opening or incision (3). There is a small parallelepiped projection (15) centered longitudinally along the vertical inside lateral face so as to be positioned laterally between the middle opening or incision (3) and the edge's (7) void accommodation space (8) and adjacent the small threaded hole (11). The projection (15) aids in the fitting of the fin's (2) base (6) within the fitting cup (10) and is received by a correspondingly shaped recess (14) of the fin's (2) base (6).

The illustrated embodiment of the fin assembly permits the adjustment of the removable lateral fins in a surfboard in a totally efficient and practical way for several types of user applications that require an accurate, secure, and versatile manner of coupling multiple surfboard lateral fins (2) to a surfboard while permitting tuning of the attack angles of the lateral fins (2) by the manual adjustment of the lateral fins (2) to the fitting cup (1) in the surfboard by the surfer before the practice of the sport.

What is claimed is:

1. A fin assembly for adjustably coupling a fin to a board used for supporting a user upon a fluid during motion, the fin assembly comprising:

(a) a fin having a base, the base including a substantially semicircular portion and a front tip;

(b) a fin box adapted to be attached to a board, the fin box having an opening for receiving the base of the fin, wherein a rear end of the opening has a substantially semicircular portion for receiving the semicircular portion of the base and wherein a front end of the opening has a plurality of rifts, wherein the front tip of the base is adapted to be selectively disposed in one of the plurality of rifts, and wherein changing the rift that the front tip is disposed in changes an angle of the fin with respect to a longitudinal axis of the board; and (c) a fastening assembly for removably securing the fin to the fin box.

2. The fin assembly of claim 1, wherein the fin includes a lateral edge extending outward from the base of the fin, and wherein the fastening assembly includes a fastener for coupling the lateral edge to the fin box.

3. The fin assembly of claim 2, wherein the lateral edge includes a hole and the fin box includes a corresponding hole, and wherein the fastener is adapted to secure the fin to the fin box by the fastener passing through the holes.

4. The fin assembly of claim 1, wherein the lateral edge is semicircular in shape.

5. The fin assembly of claim 1, wherein the fin box includes a projection configured to be received within a recess disposed on the base of the fin when the fin is coupled to the fin box.

6. The fin assembly of claim 5, wherein the projection is substantially parallelepiped in shape.

* * * * *